US010748502B2

(12) United States Patent
Liao et al.

(10) Patent No.: US 10,748,502 B2
(45) Date of Patent: Aug. 18, 2020

(54) DRIVING METHOD OF DISPLAY PANEL AND DISPLAY DEVICE

(71) Applicant: Shenzhen China Star Optoelectronics Semiconductor Display Technology Co., Ltd., Shenzhen (CN)

(72) Inventors: Bing-jei Liao, Shenzhen (CN); Yu Wu, Shenzhen (CN); Xiaoliang Guan, Shenzhen (CN); Geng Wang, Shenzhen (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 302 days.

(21) Appl. No.: 15/751,105

(22) PCT Filed: Jan. 22, 2018

(86) PCT No.: PCT/CN2018/073591
§ 371 (c)(1),
(2) Date: Feb. 7, 2018

(87) PCT Pub. No.: WO2019/127767
PCT Pub. Date: Jul. 4, 2019

(65) Prior Publication Data

US 2020/0090617 A1 Mar. 19, 2020

(30) Foreign Application Priority Data

Dec. 31, 2017 (CN) ..... 2017 1 1499414

(51) Int. Cl.
*G09G 3/36* (2006.01)

(52) U.S. Cl.
CPC ..... *G09G 3/3688* (2013.01); *G09G 3/3607* (2013.01); *G09G 3/3614* (2013.01); *G09G 2310/027* (2013.01)

(58) Field of Classification Search
CPC .... G09G 3/3688; G09G 3/3607; G09G 3/361; G09G 2310/027; G09G 2300/0823; G09G 2310/0254
See application file for complete search history.

(56) References Cited

U.S. PATENT DOCUMENTS

2007/0229554 A1 10/2007 Kawasaki et al.
2008/0036718 A1 2/2008 Lee
(Continued)

FOREIGN PATENT DOCUMENTS

CN 101009083 A 8/2007
CN 104966484 A 10/2015
EP 2 207 254 A2 7/2010

*Primary Examiner* — Michael Pervan
(74) *Attorney, Agent, or Firm* — Brinks Gilson & Lione

(57) ABSTRACT

A driving method of a display panel and a display device are provided. The method includes: receiving an external display data; changing a luminance signal of the sub-pixel corresponding to each pixel unit of a display panel in the display data, to generate a data signal; sending the data signal; wherein the luminance of one sub-pixel in the two adjacent sub-pixels in the same color after being changed, is greater than the luminance before being changed, and the luminance of the other sub-pixel after being changed, is smaller than the luminance before being changed. The present disclosure can make the orientation of the liquid crystal molecules in the liquid crystal display panel may be more rich, and the chromaticity viewing angle of the liquid crystal display panel may be improved.

15 Claims, 3 Drawing Sheets

(56) References Cited

U.S. PATENT DOCUMENTS

| | | | | |
|---|---|---|---|---|
| 2011/0025664 | A1* | 2/2011 | Liao | G09G 3/3614 345/209 |
| 2014/0313244 | A1 | 10/2014 | Yang et al. | |
| 2016/0351136 | A1 | 12/2016 | He et al. | |
| 2017/0053578 | A1 | 2/2017 | Chen et al. | |
| 2017/0140715 | A1 | 5/2017 | Lien et al. | |
| 2017/0278444 | A1 | 9/2017 | Tien et al. | |
| 2018/0053461 | A1 | 2/2018 | Tien et al. | |
| 2018/0151136 | A1* | 5/2018 | Oh | G09G 3/3614 |
| 2019/0005902 | A1 | 1/2019 | Chen | |

* cited by examiner

DRIVING METHOD OF DISPLAY PANEL AND DISPLAY DEVICE

CROSS-REFERENCE TO RELATED APPLICATIONS

The present application is a 35 U.S.C. § 371 National Phase conversion of International (PCT) Patent Application No. PCT/CN2018/073591 filed on Jan. 22, 2018, which claims foreign priority to Chinese Patent Application No. 201711499414.3, filed on Dec. 31, 2017 in the State Intellectual Property Office of China, the entire contents of which are hereby incorporated by reference.

FIELD

The present disclosure relates to a technology of display, and more particularly, to a driving method of a display panel and a display device.

BACKGROUND

The use of liquid crystal display (LCD) has become increasingly common, and requirements for LCD are getting higher and higher. The focus of LCD research is to improve the resolution, chromaticity viewing angle and other technologies of LCD. Currently, the improvement of chromaticity viewing angle of LCD is mainly achieved by the optimization of the front-end process such as the pixel structure, or the preprocessing of input data.

In long-term research and development, the inventor of the present application found that, in the optimization of the front-end process of a vertical alignment liquid crystal mode (VA mode) LCD, comparing with the LCD with 4 domain flip pixel structure, the LCD with 8 domain flip pixel structure has been significantly improved. However, comparing with the in-plane-switching liquid crystal mode (IPS mode) LCD and the organic light-emitting diode (OLED) panel, the chromaticity viewing angle is still low, so that the chromaticity viewing angle in the LCD with 8 domain flip pixel structure still needs to be improved.

SUMMARY

The present disclosure provides a driving method of display and a display device to solve the technical problem of low chromaticity viewing angle of the VA mode LCD in the related art.

In order to solve the above-mentioned technical problem, a technical solution adopted by the present disclosure is to provide a driving method of a display panel which comprises: receiving an external display data by a timing controller; changing a luminance signal of a sub-pixel corresponding to each pixel unit of the display panel in the display data by the timing controller, to generate a data signal; wherein a luminance of one sub-pixel in two adjacent sub-pixels in a same color after being changed, is higher than the luminance before being changed, and the luminance of the other sub-pixel after being changed, is lower than the luminance before being changed; sending the data signal by the timing controller to a source driver, so that the source driver drives a data line according to the data signal, and the sub-pixel is displayed.

In order to solve the above-mentioned technical problem, a further technical solution adopted by the present disclosure is to provide a display device, wherein which comprises: a display panel comprising a plurality of data lines and a plurality of pixel units; each of the plurality of pixel units comprising three sub-pixels; the sub-pixels being arranged in a matrix, the sub-pixels in odd and even rows in a same column connected to different data lines respectively, to form a 8 domain flip pixel structure; a driving component comprising a timing controller and a source driver; receiving an external display data by the timing controller; changing a luminance signal of the sub-pixel corresponding to each pixel unit of the display panel in the display data by the timing controller, to generate a data signal; sending the data signal to a source driver, so that the source driver drives a data line according to the data signal, and the sub-pixel is displayed; wherein the luminance of one sub-pixel in two adjacent sub-pixels in a same color after being changed, is higher than the luminance before being changed, and the luminance of the other sub-pixel after being changed, is lower than the luminance before being changed.

In the present disclosure, by changing the luminance of sub-pixel of each pixel in the display data, the luminance of one sub-pixel in the two adjacent sub-pixels after being changed, is greater than the luminance before being changed, and the luminance of the other sub-pixel after being changed, is smaller than the luminance before being changed, so that the orientation of the liquid crystal molecules in the LCD panel may be more rich, and the chromaticity viewing angle of the LCD panel may be improved.

BRIEF DESCRIPTION OF THE DRAWINGS

In order to clearly illustrate the technical solutions of the present disclosure, the drawings used in the description of the embodiments will be briefly described. It is understood that the drawings described herein are merely some embodiments of the present disclosure. Those skilled in the art may derive other drawings from these drawings without inventive effort.

DETAILED DESCRIPTION

The detailed description set forth below is intended as a description of the subject technology with reference to the appended figures and embodiments. It is understood that the embodiments described herein include merely some parts of the embodiments of the present disclosure, but do not include all the embodiments. Based on the embodiments of the present disclosure, all other embodiments that those skilled in the art may derive from these embodiments are within the scope of the present disclosure.

In the embodiment of the present disclosure, by changing the luminance of sub-pixel of the each pixel unit in the display data, so that the orientation of the liquid crystal molecules in the LCD panel may be more rich, and the chromaticity viewing angle of the LCD panel may be improved.

Figure 1:
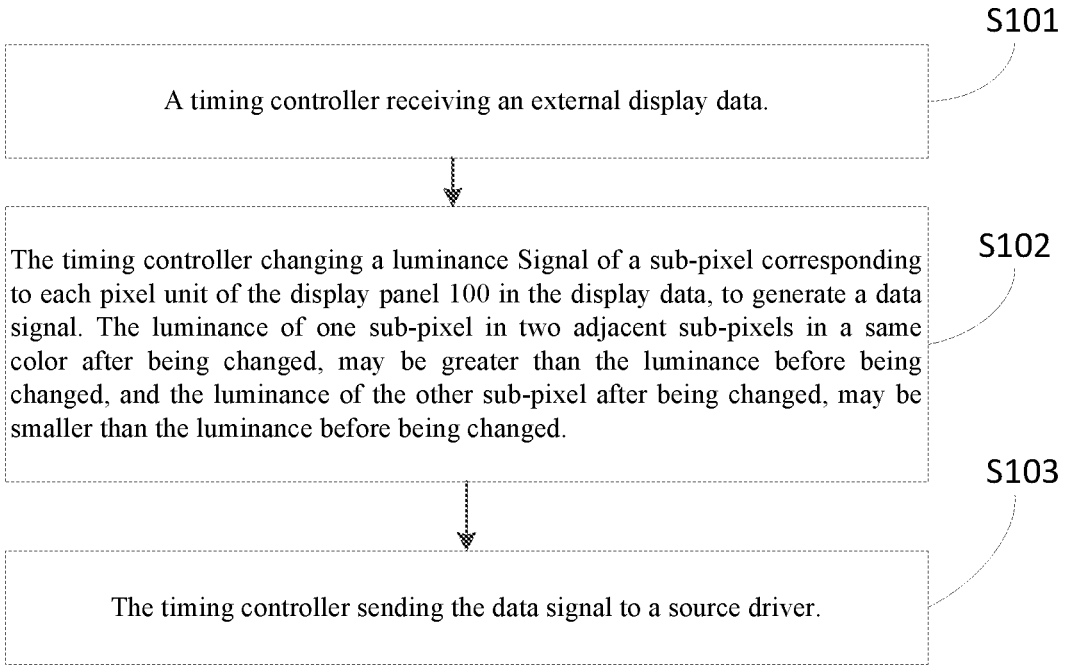
FIG. 1 is a flow chart of a driving method of a display panel in accordance with an embodiment in the present disclosure.
Figure 2:
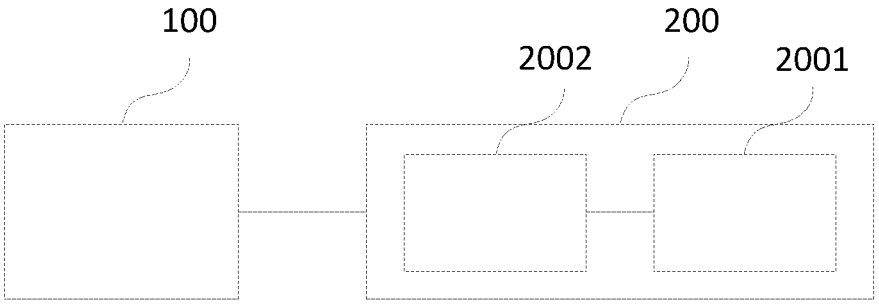
FIG. 2 is a structural illustration of a driving method of a display panel in accordance with an embodiment in the present disclosure.
Figure 3:
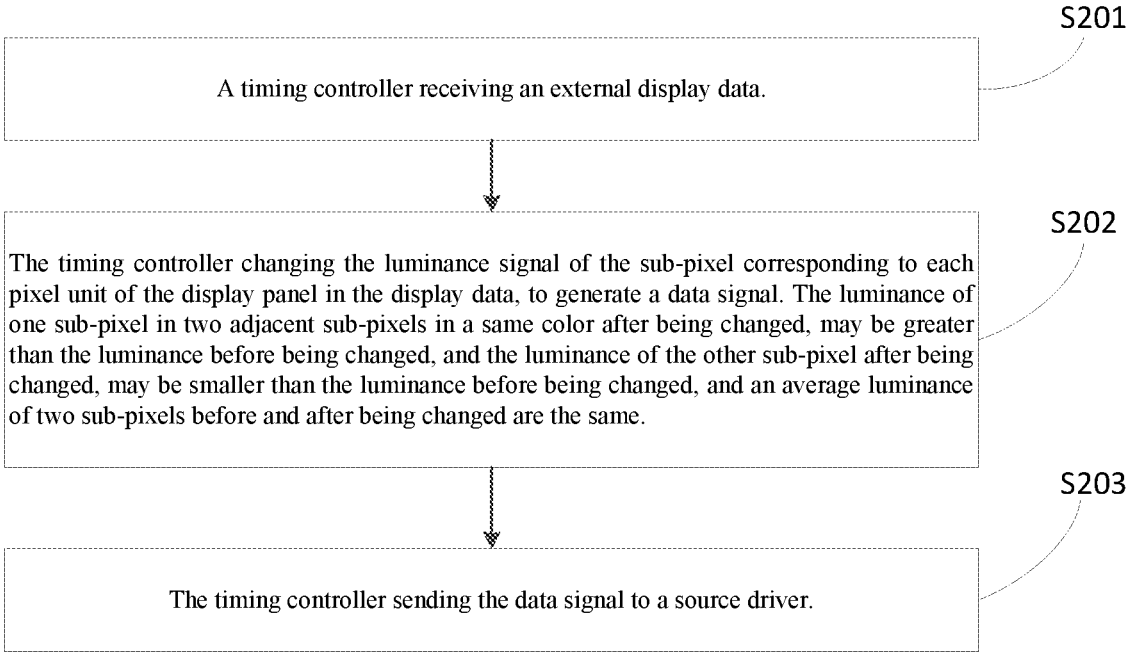
FIG. 3 is a flow chart of a driving method of a display panel in accordance with another embodiment in the present disclosure.
Figure 4:
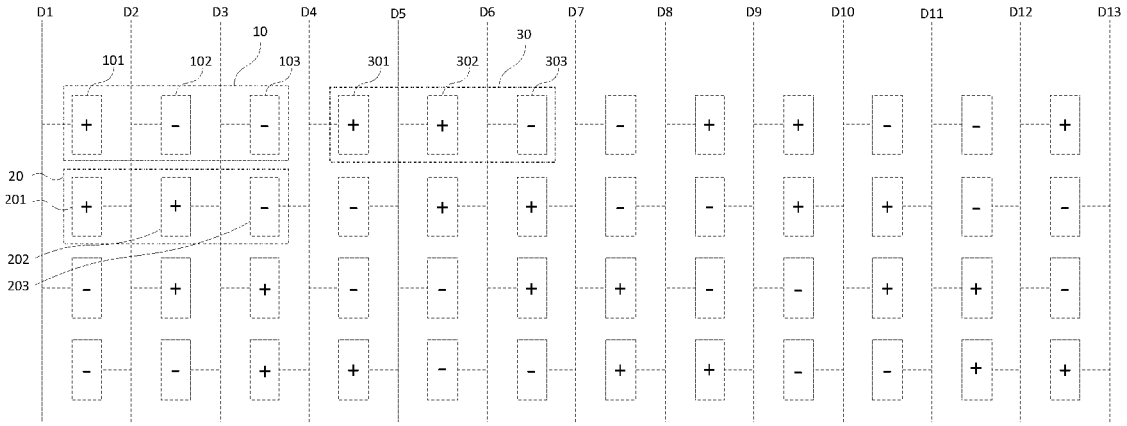
FIG. 4 is a structural illustration of setting sub-pixel polarity in accordance with another embodiment of a driving method of a display panel in the present disclosure.
Figure 5:
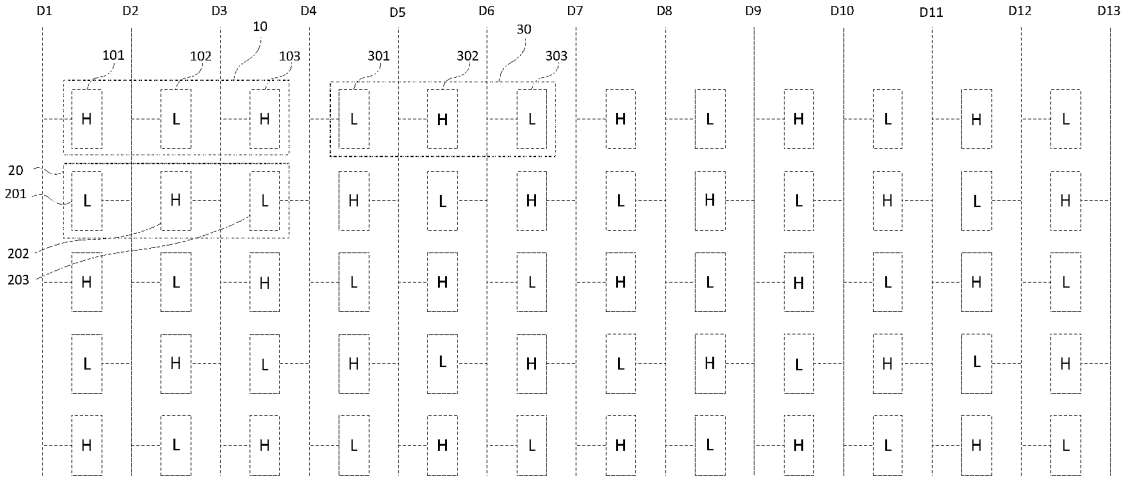
FIG. 5 is a structural illustration of setting sub-pixel luminance in accordance with another embodiment of a driving method of a display panel in the present disclosure.

Referring to FIG. 1 and FIG. 2, an embodiment of the driving method of a display panel in the present disclosure may comprise:

S101, a timing controller 2001 receiving an external display data.

Specifically, the display data sent from an outside may be received by a data line of a display device.

S102, the timing controller 2001 changing a luminance signal of a sub-pixel corresponding to each pixel unit of the display panel 100 in the display data, to generate a data signal.

The luminance of one sub-pixel in two adjacent sub-pixels in a same color after being changed, may be greater than the luminance before being changed, and the luminance of the other sub-pixel after being changed, may be smaller than the luminance before being changed.

S103: the timing controller 2001 sending the data signal to a source driver 2002, so that the source driver 2002 may drive a data line according to the data signal, and the sub-pixel is displayed.

Specifically, the display panel may have a plurality of data lines and scan lines (not shown in figure) arranged cross each other, and may have a plurality of pixel units. The each pixel unit may comprise three sub-pixels. A thin film transistor may be arranged on the each sub-pixel, and a liquid crystal may be arranged between a pixel electrode and a common electrode. When inputting a voltage to the current scan line, the thin film transistor on the scan line may be turned on, and the thin film transistor on the other scan line may be turned off. The data signal may be applied to the sub-pixel of the thin film transistor at a turn-on state by the data line, and the sub-pixel may control the light transmittance of the liquid crystal in the each sub-pixel by a voltage difference between a voltage applied to the thin film transistor and a voltage on the common electrode, to display a predetermined image.

In the embodiment of the present disclosure, by changing the luminance of sub-pixel of each pixel unit in the display data, the luminance of one sub-pixel in the two adjacent sub-pixels in the same color after being changed, may be greater than the luminance before being changed, and the luminance of the other sub-pixel after being changed, may be smaller than the luminance before being changed, so that the orientation of the liquid crystal molecules in the LCD panel may be more rich, and the chromaticity viewing angle of the LCD panel may be improved.

Referring to FIG. 2 to FIG. 5, another embodiment of the driving method of a display panel in the present disclosure comprises:

S201, a timing controller 2001 receiving an external display data.

Specifically, a display device may comprise a display panel 100 and a driving component 200. The display panel 100 may comprise a plurality of data lines and a plurality of pixel units. Each of the plurality of pixel units may comprise three sub-pixels. The sub-pixels may be arranged in a matrix. The sub-pixels in odd and even rows in a same column may be connected to different data lines respectively, to form a 8 domain flip pixel structure. The driving component 200 may comprise a timing controller 2001 and a source driver 2002.

In the present embodiment, data lines D1 to D13 are treated as an example. A plurality of data lines are arranged longitudinally between sub-pixels respectively, the sub-pixels in the odd rows are connected to the data line on a left side, and the sub-pixels in the even rows are connected to the data line on a right side. A first pixel unit 10 comprises a first sub-pixel 101, a second sub-pixel 102 and a third sub-pixel 103, which are arranged in a horizontal direction sequentially. A second pixel unit 20 comprises a fourth sub-pixel 201, a fifth sub-pixel 202 and a sixth sub-pixel 203. The first sub-pixel 101 and the fourth sub-pixel 201 are located in a same column, the second sub-pixel 102 and the fifth sub-pixel 202 are located in a same column, and the third sub-pixel 103 and the sixth sub-pixel 203 are located in the a column. In the first column, the sub-pixels in the odd rows (e.g., the first sub-pixel 101), are connected to the first data line D1 on the left side; and the sub-pixels in the even rows (e.g., the fourth sub-pixel 201), are connected to the second data line D2 on the right side. In the second column, the sub-pixels in the odd rows (e.g., the second sub-pixel 102), are connected to the second data line D2 on the left side; and the sub-pixels in the even rows (e.g., the fifth sub-pixel 202), are connected to the third data line D3 on the right side. And so on, the sub-pixels are connected to the data lines on the left or right side respectively. In the present embodiment, the display data may comprise a luminance signal and a polarity inversion control signal. The sub-pixels present different luminance according to the luminance signal, and the sub-pixels present different polarities according to the polarity inversion control signal.

In the present embodiment, the polarity inversion control signal may be a polarity inversion control signal of a 1+2 row line dot inversion mode. The first sub-pixel 101 in the first pixel unit 10 may have a positive polarity; the second sub-pixel 102 and the third sub-pixel 103 adjacent to the first sub-pixel 101 laterally, may both have a negative polarity; and the polarity of the sub-pixels in the third pixel unit 30 adjacent to the third sub-pixel 103 laterally, may be in turns of the 1+2 row line dot inversion mode. The fourth sub-pixel 201 in the second pixel 20 adjacent to the first sub-pixel 101 longitudinally, may have a positive polarity; and the polarity of the sub-pixels adjacent to the fourth sub-pixel 201 longitudinally, may be also in turns of the 1+2 row line dot inversion mode.

In the present embodiment, the 4 rows and 13 columns of sub-pixels may form a minimum basic unit for a 8 domain flip pixel structure of a wide-angle display, and a display panel may be formed by arranging a plurality of minimum basic units. In other embodiments, the minimum basic unit for a 8 domain flip pixel structure of the wide-angle display may also be formed by the sub-pixels of other rows and columns base on the polarity inversion control signal.

S202, the timing controller 2001 changing the luminance signal of the sub-pixel corresponding to each pixel unit of the display panel in the display data, to generate a data signal.

The luminance of one sub-pixel in two adjacent sub-pixels in a same color after being changed, may be higher than the luminance before being changed, and the luminance of the other sub-pixel after being changed, may be lower than the luminance before being changed. In the present embodiment, in the first pixel 10, the first sub-pixel 101 may be a blue sub-pixel, the second sub-pixel 102 may be a green sub-pixel, and the third sub-pixel 103 may be a red sub-pixel. In the second pixel 20, a fourth sub-pixel 201 may be a blue sub-pixel, and the fifth sub-pixel 202 may be a green sub-pixel. In the third pixel 30, a seventh sub-pixel 301 may be a blue sub-pixel, and an eighth sub-pixel 302 may be a green sub-pixel. The luminance of the first sub-pixel 101 after being changed, may be higher than the luminance before being changed, it is shown in the figure as a high (High, abbreviated as H) luminance, the luminance of the seventh sub-pixel 301 in the same color adjacent to the first sub-pixel 101 laterally after being changed, may be lower than the luminance before being changed, it is shown in the figure as a low (Low, abbreviated as L) luminance. The luminance of the seventh sub-pixel 201 in the same color adjacent to the first sub-pixel 101 laterally after being changed, may be lower than the luminance before being changed, i.e., a low luminance; the luminance of the second sub-pixel 102 after being changed, may be lower than the luminance before being changed, i.e., a low luminance; so that the eighth sub-pixel 302 and the fifth sub-pixel 202 in the same color adjacent to the second sub-pixel 102 laterally and respectively may be a high luminance. And so on, two adjacent sub-pixels in the same color on the display panel in the lateral and longitudinal direction, are high luminances or low luminances alternately and respectively.

In the present embodiment, the luminance of one sub-pixel in the two adjacent sub-pixels after being changed, may be greater than the luminance before being changed, and the luminance of the other sub-pixel after being changed, may be smaller than the luminance before being changed. For example, the luminance of the first sub-pixel 101 after being changed, may be greater than the luminance before being changed, i.e., a high luminance, so that the luminance of the second sub-pixel 102 adjacent to the first sub-pixel laterally after being changed, may be smaller than which before being changed. Sub-pixels have the same color in the longitudinally direction. Therefore, as long as one sub-pixel in two adjacent sub-pixels of the same color in the longitudinal direction, has a high luminance and the other sub-pixel has a low luminance, it may be satisfied that one sub-pixel in two adjacent sub-pixels in the longitudinal direction has a high luminance and the other sub-pixel has a low luminance. Each pixel in the present embodiment may comprise three sub-pixels, and the sub-pixels may be arranged in the order of a blue sub-pixel, a green sub-pixel, and a red sub-pixel in the laterally direction. Therefore, when it is satisfied that one sub-pixel in two adjacent sub-pixels laterally in the same color, has a high luminance and the other sub-pixel has a low luminance, it may be satisfied that one sub-pixel in two adjacent sub-pixels has a high luminance and the other sub-pixel has a low luminance.

In other embodiments, a color of the pixel may also be that the first sub-pixel 101 is a red sub-pixel, the second sub-pixel 102 is a green sub-pixel, and the third sub-pixel 103 is a blue sub-pixel.

In the present embodiment, the luminance of the sub-pixels connected to odd-numbered columns of data lines in the display panel 100 after being changed, may be greater than the luminance before being changed, and the luminance of the sub-pixels connected to even-numbered columns of data lines in the display panel 100 after being changed, may be smaller than the luminance before being changed. For example, the first sub-pixel 101 connected to the data line D1, the third sub-pixel 103 connected to the data line D3, the fifth sub-pixel 202 connected to the data line D3, and the eighth sub-pixel 302 connected to the data line D5, may have a high luminance; the second sub-pixel 102 connected to the data line D2, the fourth sub-pixel 201 connected to the data line D2, the seventh sub-pixel 301 connected to the data line D4, the sixth sub-pixel 203 connected to the data line D4, and the ninth sub-pixel 303 connected to the data line D6, may have a low luminance.

In the present embodiment, an average value of the luminance of two adjacent sub-pixels in the same color, may be equal to an average value of the luminance before being changed. In the present embodiment, changing a grayscale value of the sub-pixel to change the luminance of the sub-pixel. For example, if grayscale values of the first sub-pixel 101 and the seventh sub-pixel 301 adjacent laterally in the same color are both 100 (unit), an average value of the grayscale value of the first sub-pixel 101 and the seventh sub-pixel 301 is 100; if the grayscale value of the first sub-pixel is 120 after being changed and the grayscale value of the seventh sub-pixel 301 after being changed is 80, the average value of the grayscale value of the first sub-pixel 101 and the seventh sub-pixel 301 is 100, the same as before the change.

S203: the timing controller 2001 sending the data signal to a source driver 2002, so that the source driver 2002 drives a data line according to the data signal, and the sub-pixel is displayed.

In the present embodiment, by changing the luminance of the sub-pixel in the each pixel without changing the average value of luminance of two adjacent sub-pixels in the same color, the arrangement of the liquid crystal molecules in the liquid crystal panel may be more rich, and the chromaticity viewing angle of the LCD panel may be improved. Taking a pure grayscale display image as an example, an grayscale value of the each pixel in the entire display image in the original display data is 100. In the related art, the liquid crystal in the LCD panel has only one arrangement of grayscale value of 100. In the present embodiment, changing the grayscale value of one sub-pixel in the two adjacent sub-pixels to 120, and changing the grayscale value of the other sub-pixel to 80, so that the liquid crystal in the LCD panel may have two arrangements of grayscale values of 120 and 80. The arrangement of the liquid crystal molecules in the liquid crystal panel may be more rich, and the chromaticity viewing angle of the LCD panel may be improved.

In the embodiment of the present disclosure, by changing the luminance of sub-pixel of the each pixel in the display data, the luminance of one sub-pixel in the two adjacent sub-pixels in the same color after being changed, may be greater than the luminance before being changed, and the luminance of the other sub-pixel after being changed, may be smaller than the luminance before being changed, further, the average luminance of two sub-pixels before and after being changed are the same, so that the orientation of the liquid crystal molecules in the LCD panel may be more rich, and the chromaticity viewing angle of the LCD panel may be improved.

Referring to FIG. 2, the display device of the present disclosure may comprise a display panel 100 and a driving component 200. Specifically, structures of the display panel 100 and the driving component 200 may be referred to the above-mentioned embodiment of the driving method of the display panel, therefore no additional description is given herebelow.

In the embodiment of the present disclosure, by changing the luminance of sub-pixel of the each pixel in the display data, the luminance of one sub-pixel in the two adjacent sub-pixels in the same color after being changed, may be greater than the luminance before being changed, and the luminance of the other sub-pixel after being changed, may be smaller than the luminance before being changed, so that the orientation of the liquid crystal molecules in the LCD panel may be more rich, and the chromaticity viewing angle of the LCD panel may be improved.

It is understood that the descriptions above are only embodiments of the present disclosure. It is not intended to limit the scope of the present disclosure. Any equivalent transformation in structure and/or in scheme referring to the instruction and the accompanying drawings of the present disclosure, and direct or indirect application in other related technical field, are included within the scope of the present disclosure.

What is claimed is:

1. A method of driving a display panel comprising:

receiving, by a timing controller of the display panel, display data from an external source;

generating a data signal from the external display data representing luminance information associated with sub-pixels of the display, including changing a luminance value of a sub-pixel corresponding to each pixel unit of the display panel; wherein a luminance value of a first sub-pixel of two adjacent sub-pixels is a same color after changing, is higher than before, and a luminance value of a second sub-pixel of the two adjacent sub-pixels after changing, is lower than before;

sending, by the timing controller, the data signal to a source driver to drive a data line and activate the sub-pixels;

wherein an average value of the luminance of the two adjacent sub-pixels of the same color stays the same;

wherein the display data further comprises a polarity inversion control signal, and the polarity inversion control signal is a polarity inversion control signal of a 1+2 row line dot inversion mode.

2. The method as recited in claim 1, wherein the changing the luminance value of the sub-pixel corresponding to each pixel unit of the display panel in the external display data, comprises:

changing the luminance value of the two adjacent sub-pixels respectively, so that the luminance value of the first sub-pixel of the two adjacent sub-pixels after changing, is higher than before, and the luminance value of the second sub-pixel after being changed, is lower than before.

3. The method as recited in claim 2, wherein a luminance value of the sub-pixels connected to odd-numbered columns of data lines in the display panel after changing, is higher than before, and a luminance value of the sub-pixels connected to even-numbered columns of data lines in the display panel changing, is lower than before.

4. The method as recited in claim 1, wherein the changing of the luminance value of the sub-pixel corresponding to the each pixel unit of the external display panel in the display data, comprises:

changing a grayscale value of the sub-pixel.

5. A method of driving a display panel, comprising:

receiving, by a timing controller of the display panel, display data from an external source;

generating a data signal from the external display data representing luminance information associated with sub-pixels of the display, including changing a luminance value of a sub-pixel corresponding to each pixel unit of the display panel; wherein a luminance value of a first sub-pixel of two adjacent sub-pixels is a same color after changing, is higher than before, and a luminance value of a second sub-pixel of the two adjacent sub-pixels after changing, is lower than before;

sending, by the timing controller, the data signal to a source driver to drive a data line, and activate the sub-pixels;

wherein the display data further comprises a polarity inversion control signal;

wherein the polarity inversion control signal is a polarity inversion control signal of a 1+2 row line dot inversion mode.

6. The method as recited in claim 5, wherein the changing the luminance value of the sub-pixel corresponding to each pixel unit of the display panel in the external display data, comprises:

changing the luminance value of the two adjacent sub-pixels respectively, so that the luminance value of the first sub-pixel of the two adjacent sub-pixels after changing, is higher than before, and the luminance value of the second sub-pixel after changing, is lower than before.

7. The method as recited in claim 6, wherein a luminance value of the sub-pixels connected to odd-numbered columns of data lines in the display panel after changing, is higher than before, and a luminance value of the sub-pixels connected to even-numbered columns of data lines in the display panel after changing, is lower than before.

8. The method as recited in claim 5, wherein an average value of the luminance of the two adjacent sub-pixels of the same color stays the same.

9. The method as recited in claim 5, wherein the changing of the luminance value signal of the sub-pixel corresponding to the each pixel unit of the external display panel in the display data, comprises:

changing a grayscale value.

10. A display device, comprising:

a display panel comprising a plurality of data lines and a plurality of pixel units; each of the plurality of pixel units comprising three sub-pixels; the sub-pixels being arranged in a matrix, the sub-pixels in odd and even rows in a same column connected to different data lines respectively, to form an 8 domain flip pixel structure;

a driving component comprising a timing controller and a source driver, wherein, the timing controller receives a display data from an external source; changes a luminance value of the sub-pixel corresponding to each pixel unit of the display panel; and sends, by the timing controller, the data signal to the source driver to drive the data line, and to activate the sub-pixel;

wherein a luminance value of a first sub-pixel of two adjacent sub-pixels is a same color after changing, is higher than before, and the luminance value of a second sub-pixel after changing, is lower than before;

wherein the display data further comprises a polarity inversion control signal;

wherein the polarity inversion control signal is a polarity inversion control signal of a 1+2 row line dot inversion mode.

11. The display device as recited in claim 10, wherein the plurality of data lines are arranged longitudinally between the sub-pixels respectively, the sub-pixels in odd rows are connected to the data line on a first side, and the sub-pixels in even rows are connected to the data line on a second side.

12. The display device as recited in claim 11, wherein the luminance value of the first sub-pixel of the two adjacent sub-pixels after changing, is higher than before, and the luminance value of the second sub-pixel after changing, is lower than before.

13. The display device as recited in claim 12, wherein the luminance value of the sub-pixels connected to odd-numbered columns of the data lines in the display panel after changing, is higher than before, and the luminance value of the sub-pixels connected to even-numbered columns of the data lines in the display panel after changing, is lower than before.

14. The display device as recited in claim 10, wherein the pixel unit comprises a red sub-pixel, a green sub-pixel and a blue sub-pixel.

15. The display device as recited in claim 10, wherein an average value of the luminance of two adjacent sub-pixels of the same color stays the same.

* * * * *